US005937374A

United States Patent [19]

Bartkowiak et al.

[11] Patent Number: 5,937,374

[45] Date of Patent: Aug. 10, 1999

[54] SYSTEM AND METHOD FOR IMPROVED PITCH ESTIMATION WHICH PERFORMS FIRST FORMANT ENERGY REMOVAL FOR A FRAME USING COEFFICIENTS FROM A PRIOR FRAME

[75] Inventors: John G. Bartkowiak; Mark A. Ireton, both of Austin, Tex.

[73] Assignee: Advanced Micro Devices, Inc., Sunnyvale, Calif.

[21] Appl. No.: 08/647,843

[22] Filed: May 15, 1996

[51] Int. Cl.[6] ..... G10L 3/02

[52] U.S. Cl. ..... 704/209; 704/206

[58] Field of Search ..... 395/2.16, 2.1, 395/2.14, 2.15, 2.17, 2.18, 2.32

[56] References Cited

U.S. PATENT DOCUMENTS

| | | | |
|---|---|---|---|
| 4,879,748 | 11/1989 | Picone et al. | 381/49 |
| 4,890,328 | 12/1989 | Prezas et al. | 381/38 |
| 4,912,764 | 3/1990 | Hartwell et al. | 381/38 |
| 5,018,200 | 5/1991 | Ozawa | 381/36 |
| 5,414,796 | 5/1995 | Jacobs et al. | 395/2.3 |
| 5,491,771 | 2/1996 | Gupta et al. | 395/2.32 |
| 5,596,676 | 1/1997 | Swaminathan et al. | 395/2.17 |
| 5,629,955 | 5/1997 | McDonough | 375/200 |
| 5,657,420 | 8/1997 | Jacobs et al. | 395/2.32 |
| 5,812,966 | 9/1998 | Byun et al. | 704/207 |

OTHER PUBLICATIONS

Chen, "One Dimensional Digital Signal Processing", 1979, Electrical Engineering and Electronics.

*Primary Examiner*—David R. Hudspeth
*Assistant Examiner*—Michael N. Opsasnick
*Attorney, Agent, or Firm*—Conley, Rose & Tayon; Jeffrey C. Hood

[57] ABSTRACT

An improved vocoder system and method for estimating pitch in a speech waveform which pre-filters speech data with improved efficiency and reduced computational requirements. The vocoder system is preferably a low bit rate speech coder which analyzes a plurality of frames of speech data in parallel. Once the LPC filter coefficients and the pitch for a first frame have been calculated, the vocoder then looks ahead to the next frame to estimate the pitch, i.e., to estimate the pitch of the next frame. In the preferred embodiment of the invention, the vocoder filters speech data in a second frame using a plurality of the coefficients from a first frame as a multi pole analysis filter. These coefficients are used as a "crude" two pole analysis filter. The vocoder preferably includes a first processor which performs coefficient calculations for the second frame, and a second processor which performs pre-filtering and pitch estimation, wherein the second processor operates substantially simultaneously with the first processor. Thus, the vocoder system uses LPC coefficients for a first frame as a "crude" multi pole analysis filter for a subsequent frame of data, thereby performing pre-filtering on a frame without requiring previous coefficient calculations for that frame. This allows pre-filtered pitch estimation and LPC coefficient calculations to be performed in parallel. This provides a more efficient pitch estimation, thus enhancing vocoder performance.

20 Claims, 12 Drawing Sheets

Representation of speech signals.

Range of bit rates for various types of speech representations.

Source-system model of speech production.

General discrete-time model for speech production.

Block diagram of simplified model for speech production.

(a) Correlation values
(b) Threshold values
(c) Speech frame under analysis

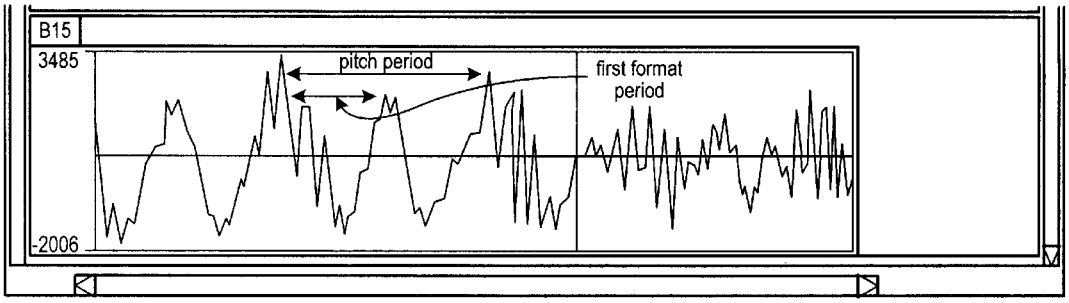
FIG. 12a
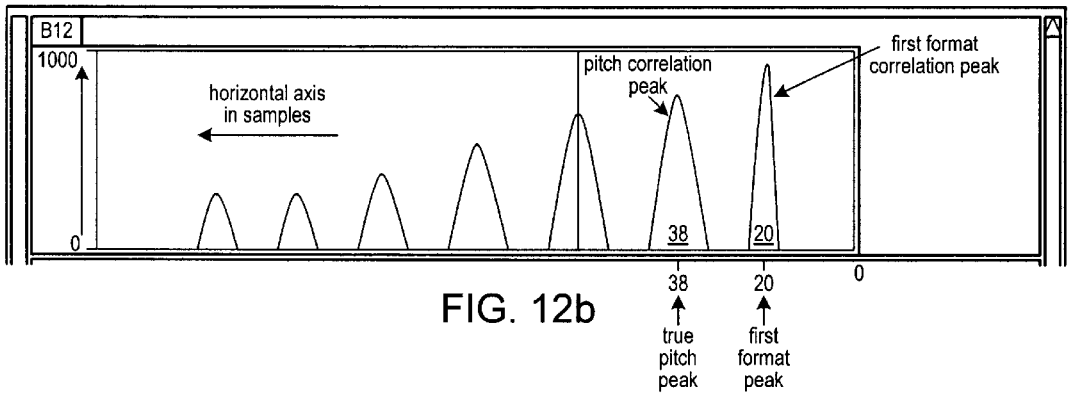
FIG. 12b
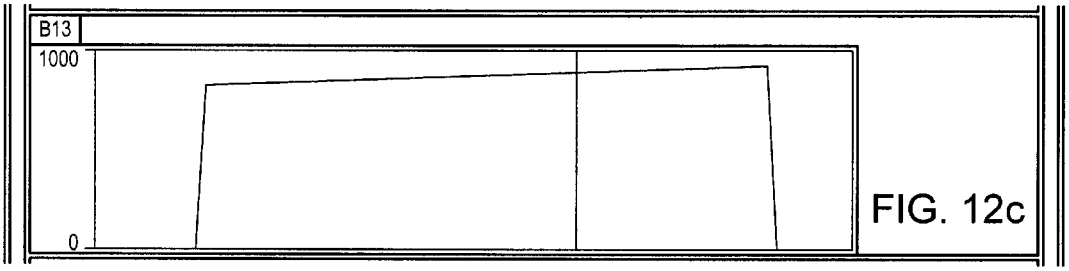
FIG. 12c
FIG. 12c (a) Correlation values
(b) Threshold values
(c) Speech frame under analysis Method of the Present Invention 256 Sample FFT of Speech Frame under Analysis

SYSTEM AND METHOD FOR IMPROVED PITCH ESTIMATION WHICH PERFORMS FIRST FORMANT ENERGY REMOVAL FOR A FRAME USING COEFFICIENTS FROM A PRIOR FRAME

FIELD OF THE INVENTION

The present invention relates generally to a vocoder which receives speech waveforms and generates a parametric representation of the speech waveforms, and more particularly to an improved vocoder system and method for performing pitch estimation which uses LPC coefficients for a current frame to pre-filter first Formant energy from a subsequent frame.

DESCRIPTION OF THE RELATED ART

Digital storage and communication of voice or speech signals has become increasingly prevalent in modern society. Digital storage of speech signals comprises generating a digital representation of the speech signals and then storing those digital representations in memory. As shown in FIG. 1, a digital representation of speech signals can generally be either a waveform representation or a parametric representation. A waveform representation of speech signals comprises preserving the "waveshape" of the analog speech signal through a sampling and quantization process. A parametric representation of speech signals involves representing the speech signal as a plurality of parameters which affect the output of a model for speech production. A parametric representation of speech signals is accomplished by first generating a digital waveform representation using speech signal sampling and quantization and then further processing the digital waveform to obtain parameters of the model for speech production. The parameters of this model are generally classified as either excitation parameters, which are related to the source of the speech sounds, or vocal tract response parameters, which are related to the individual speech sounds.

FIG. 2 illustrates a comparison of the waveform and parametric representations of speech signals according to the data transfer rate required. As shown, parametric representations of speech signals require a lower data rate, or number of bits per second, than waveform representations. A waveform representation requires from 15,000 to 200,000 bits per second to represent and/or transfer typical speech, depending on the type of quantization and modulation used. A parametric representation requires a significantly lower number of bits per second, generally from 500 to 15,000 bits per second. In general, a parametric representation is a form of speech signal compression which uses a priori knowledge of the characteristics of the speech signal in the form of a speech production model. A parametric representation represents speech signals in the form of a plurality of parameters which affect the output of the speech production model, wherein the speech production model is a model based on human speech production anatomy.

Speech sounds can generally be classified into three distinct classes according to their mode of excitation. Voiced sounds are sounds produced by vibration or oscillation of the human vocal cords, thereby producing quasi-periodic pulses of air which excite the vocal tract. Unvoiced sounds are generated by forming a constriction at some point in the vocal tract, typically near the end of the vocal tract at the mouth, and forcing air through the constriction at a sufficient velocity to produce turbulence. This creates a broad spectrum noise source which excites the vocal tract. Plosive sounds result from creating pressure behind a closure in the vocal tract, typically at the mouth, and then abruptly releasing the air.

A speech production model can generally be partitioned into three phases comprising vibration or sound generation within the glottal system, propagation of the vibrations or sound through the vocal tract, and radiation of the sound at the mouth and to a lesser extent through the nose. FIG. 3 illustrates a simplified model of speech production which includes an excitation generator for sound excitation or generation and a time varying linear system which models propagation of sound through the vocal tract and radiation of the sound at the mouth. Therefore, this model separates the excitation features of sound production from the vocal tract and radiation features. The excitation generator creates a signal comprised of either a train of glottal pulses or randomly varying noise. The train of glottal pulses models voiced sounds, and the randomly varying noise models unvoiced sounds. The linear time-varying system models the various effects on the sound within the vocal tract. This speech production model receives a plurality of parameters which affect operation of the excitation generator and the time-varying linear system to compute an output speech waveform corresponding to the received parameters.

Referring now to FIG. 4, a more detailed speech production model is shown. As shown, this model includes an impulse train generator for generating an impulse train corresponding to voiced sounds and a random noise generator for generating random noise corresponding to unvoiced sounds. One parameter in the speech production model is the pitch period, which is supplied to the impulse train generator to generate the proper pitch or frequency of the signals in the impulse train. The impulse train is provided to a glottal pulse model block which models the glottal system. The output from the glottal pulse model block is multiplied by an amplitude parameter and provided through a voiced/unvoiced switch to a vocal tract model block. The random noise output from the random noise generator is multiplied by an amplitude parameter and is provided through the voiced/unvoiced switch to the vocal tract model block. The voiced/unvoiced switch is controlled by a parameter which directs the speech production model to switch between voiced and unvoiced excitation generators, i.e., the impulse train generator and the random noise generator, to model the changing mode of excitation for voiced and unvoiced sounds.

The vocal tract model block generally relates the volume velocity of the speech signals at the source to the volume velocity of the speech signals at the lips. The vocal tract model block receives various vocal tract parameters which represent how speech signals are affected within the vocal tract. These parameters include various resonant and unresonant frequencies, referred to as formants, of the speech which correspond to poles or zeroes of the transfer function V(z). The output of the vocal tract model block is provided to a radiation model which models the effect of pressure at the lips on the speech signals. Therefore, FIG. 4 illustrates a general discrete time model for speech production. The various parameters, including pitch, voice/unvoice, amplitude or gain, and the vocal tract parameters affect the operation of the speech production model to produce or recreate the appropriate speech waveforms.

Referring now to FIG. 5, in some cases it is desirable to combine the glottal pulse, radiation and vocal tract model blocks into a single transfer function. This single transfer function is represented in FIG. 5 by the time-varying digital filter block. As shown, an impulse train generator and random noise generator each provide outputs to a voiced/unvoiced switch. The output from the switch is provided to a gain multiplier which in turn provides an output to the time-varying digital filter. The time-varying digital filter performs the operations of the glottal pulse model block, vocal tract model block and radiation model block shown in FIG. 4.

One key aspect for generating a parametric representation of speech from a received waveform involves accurately estimating the pitch of the received waveform. The estimated pitch parameter is used later in re-generating the speech waveform from the stored parameters. For example, in generating speech waveforms from a parametric representation, a vocoder generates an impulse train comprising a series of periodic impulses separated in time by a period which corresponds to the pitch frequency of the speaker. Thus, when creating a parametric representation of speech, it is important to accurately estimate the pitch parameter. It is noted that, for an all digital system, the pitch parameter is restricted to be some multiple of the sampling interval of the system.

The estimation of pitch in speech using time domain correlation methods has been widely employed in speech compression technology. Time domain correlation is a measurement of similarity between two functions. In pitch estimation, time domain correlation measures the similarity of two sequences or frames of digital speech signals sampled at 8 KHz, as shown in FIG. 6. In a typical vocoder, 160 sample frames are used where the center of the frame is used as a reference point. As shown in FIG. 6, if a defined number of samples to the left of the point marked "center of frame" are similar to a similarly defined number of samples to the right of this point, then a relatively high correlation value is produced. Thus, detection of periodicity is possible using the so called correlation coefficient, which is defined as:

$$corcoef = \frac{\sum_{n=0}^{N-1}[x(n)-\bar{x}][x(n-d)-\overline{xd}]}{\sqrt{\sum_{n=0}^{N-1}[x(n)-\bar{x}]^2} * \sqrt{\sum_{n=0}^{N-1}[x(n-d)-\overline{xd}]^2}} \quad \text{Eqn (1)}$$

where $$\bar{x} = \frac{1}{N}\sum_{n=0}^{N-1}[x(n)] \text{ and } \overline{x(d)} = \frac{1}{N}\sum_{n=0}^{N-1}[x(n-d)] \quad \text{Eqn's (2) \& (3)}$$

The x(n−d) samples are to the left of the center point and the x(n) samples lie to the right of the center point. This function indicates the closeness to which the signal x(n) matches an earlier-in-time version of the signal x(n−d). This function displays the property that abs[corcoef]<=1. Also, if the function is equal to 1, x(n)=x(n−d) for all n.

When the delay d becomes equal to the pitch period of the speech under analysis, the correlation coefficient, corcoef, becomes maximum. For example, if the pitch is 57 samples, then the correlation coefficient will be high or maximum over a range of 57 samples. In general, pitch periods for speech lie in the range of 21–147 samples at 8 KHz. Thus, correlation calculations are performed for a number of samples N which varies between 21 and 147 in order to calculate the correlation coefficient for all possible pitch periods.

It is noted that a high value for the correlation coefficient will register at multiples of the pitch period, i.e., at 2 and 3 times the pitch period, producing multiple peaks in the correlation. In general, to remove extraneous peaks caused by secondary excitations, which are very common in voiced segments, the correlation function is clipped using a threshold function. Logic is then applied to the remaining peaks to determine the actual pitch of that segment of speech. These types of technique are commonly used as the basis for pitch estimation.

Correlation-based techniques generally have limitations in accurately estimating the pitch parameter under all conditions. In order to accurately estimate the pitch parameter, it is important to mitigate the effects of extraneous and misleading signal information which can confuse the estimation method. In particular, in speech which is not totally voiced, or contains secondary excitations in addition to the main pitch frequency, the correlation-based methods can produce misleading results. Further, the First Formant in speech, which is the lowest resonance of the vocal tract, generally interferes with the estimation process, and sometimes produces misleading results. Pitch estimation errors in speech have a highly damaging effect on reproduced speech quality. Therefore, techniques which reduce the contribution of the First Formant and other secondary excitations to the pitch estimation method are widely sought.

As mentioned above, the First Formant in speech generally interferes with the pitch estimation process. Therefore, pre-filtering methods are typically employed to remove the first Formant energy from the speech prior to performing the pitch analysis. In general, various methods are known in the art to remove extraneous and misleading information from the speech signal so that the pitch estimation can proceed smoothly. Current pre-filtering methods usually require that the vocal tract model for each frame of speech under analysis be first calculated using Linear Predictive Coding (LPC) analysis. In general, an all pole LPC Analysis Filter is designed and is then employed as a pre-filter for the time domain data. Typical analysis frame lengths and filter lengths are 160 samples and 10–12 taps respectively. However, this requirement that all of the LPC coefficients first be calculated for an all pole filter adds undesirable computation cycles to the pitch estimation process.

Low Bit Rate Vocoders

In some low bit rate speech coders, several frames of speech data are analyzed together and/or in parallel, and these frames are block coded using Vector Quantisation techniques to reduce the bit rate for transmission. Such methods allow look-ahead and look-back techniques to be employed to correct for individual parameter estimation errors. One prior art method analyzes 3 speech frames, wherein the three frames are referred to as the "previous", "current" and "next" frames of speech data. These three frames are analyzed or employed in a manner which allows information from all 3 frames to be used in the correction and estimation process.

Once the LPC filter coefficients and the pitch for a current frame have been calculated, it is then necessary to look ahead to the next frame to estimate the pitch, i.e., to estimate the pitch of the next frame. In general, it is desired to pre-filter the first Formant energy from the next frame data prior to performing the pitch estimation. Since the First Formant frequency in voiced speech is the one most likely to interfere with the pitch estimation, removing this information from the next frame's data prevents this signal information from misleading the pitch estimation process. If it is desired to pre-filter the data from the next frame prior to performing the pitch estimation, current methods require that a full LPC analysis first be performed for the next frame.

This generally requires the use of algorithms such as the Burg or Covariance Lattice algorithm to generate the 10–12 tap analysis filter. This adversely impacts the computational load for the signal processor performing the calculations and increases the algorithmic delay of the speech compression algorithm.

Therefore, an improved vocoder system and method is desired which accurately removes or filters the contribution of the First Formant and other secondary excitations prior to operation of the pitch estimation method. An improved vocoder system and method for performing pitch estimation is also desired which more efficiently filters the first Formant energy prior to the pitch estimation with reduced computational requirements. More particularly, a simpler and less computationally intensive method for removing extraneous signals from the "next frame" pitch estimation is desired.

SUMMARY OF THE INVENTION

The present invention comprises an improved vocoder system and method for estimating pitch in a speech waveform. The vocoder system performs pre-filtering of speech data with reduced computational requirements. More particularly, the vocoder system uses LPC coefficients for a first frame as a "crude" multi pole analysis filter for a subsequent frame of data, thereby performing pre-filtering on a frame without requiring any preceding coefficient calculations for that frame. This allows the LPC computations for a frame to proceed substantially in parallel with a pre-filtered pitch estimation for a frame.

In the preferred embodiment, the vocoder receives digital samples of a speech waveform, wherein the speech waveform includes a plurality of frames each comprising a plurality of samples. The vocoder then generates a parametric representation of the speech, which includes estimating a pitch parameter for each frame. In generating a parametric representation of the speech, the vocoder analyzes a plurality of frames and pre-filters one or more of the frames to remove first Formant energy prior to the pitch estimation.

The vocoder system is preferably a low bit rate speech coder which analyzes a plurality of frames of speech data together. In the preferred embodiment, the vocoder analyzes 3 speech frames, wherein the three frames are referred to as the "previous", "current" and "next" frames of speech data. These three frames are analyzed or employed in a manner which allows information from all 3 frames to be used in the correction and estimation process.

Once the LPC filter coefficients and the pitch for a first frame or current frame have been calculated, the vocoder then looks ahead to the second or next frame to perform LPC analysis in the next frame and estimate the pitch of the next frame. In the preferred embodiment of the invention, the vocoder includes a first processor which calculates the full LPC coefficients for the next frame, and a second processor which performs a pitch estimation using pre-filtering, wherein the first and second processors operate substantially in parallel. The second processor does not have access to any of the LPC coefficients until the first processor completes calculations on all coefficients, due to the recursive nature of the calculations. Therefore, in one embodiment, the second processor pre-calculates only a subset of the LPC coefficients, preferably the first two LPC coefficients, for the next frame and uses this subset of LPC coefficients as a "crude" two pole analysis filter. Thus, the method of the present invention does not require that all of the LPC coefficients be computed for first Formant filtering, but rather only the first two LPC coefficients are computed for this purpose. The first two LPC coefficients provide sufficient coefficients for a "crude" pole analysis filter which is effective in removing a substantial part of the first Formant energy from the speech data. This obviates the necessity of the full LPC computation being performed prior to pre-filtering, thus allowing the LPC calculations and the pre-filtered pitch estimation to be performed in parallel.

In the preferred embodiment of the invention, the second processor in the vocoder filters speech data in a subsequent or second frame using a plurality of the coefficients from a prior or first frame as a multi pole analysis filter. In the preferred embodiment of the invention, the second processor filters speech data in the subsequent frame using the first two coefficients previously calculated from the first or prior frame. These first two coefficients are used as a "crude" two pole analysis filter. After this pre-filtering is performed, the second processor then performs pitch estimation on the second frame to determine an estimated pitch value for the second frame. The vocoder can then compare the estimated pitch value of the second frame with the estimated pitch value of the first frame to check the estimated pitch value of the first frame.

Therefore, the vocoder includes a novel system and method for pre-filtering the data from the next frame prior to performing the pitch estimation, wherein the pre-filtering has reduced computational requirements. This pre-filtering removes the contribution of the First Formant frequency's contribution to the pitch estimation process. The pre-filtering does not require the full LPC calculations for the respective frame, thus allowing the LPC calculations and the pre-filtered pitch estimation to be performed in parallel. This provides a more efficient pitch estimation, thus enhancing vocoder performance.

BRIEF DESCRIPTION OF THE DRAWINGS

A better understanding of the present invention can be obtained when the following detailed description of the preferred embodiment is considered in conjunction with the following drawings, in which:

FIG. 12*a* illustrates a sample speech waveform; FIG. 12*b* illustrates a correlation output from the speech waveform of FIG. 12*a* using a frame size of 160 samples; and FIG. 12*c* illustrates the clipping threshold used to reduce the number of peaks in the estimation process;

DETAILED DESCRIPTION OF THE PREFERRED EMBODIMENT

Incorporation by Reference

The following references are hereby incorporated by reference.

For general information on speech coding, please see Rabiner and Schafer, *Digital Processing of Speech Signals*, Prentice Hall, 1978 which is hereby incorporated by reference in its entirety. Please also see Gersho and Gray, *Vector Quantization and Signal Compression*, Kluwer Academic Publishers, which is hereby incorporated by reference in its entirety.

Voice Storage and Retrieval System

Figure 1:
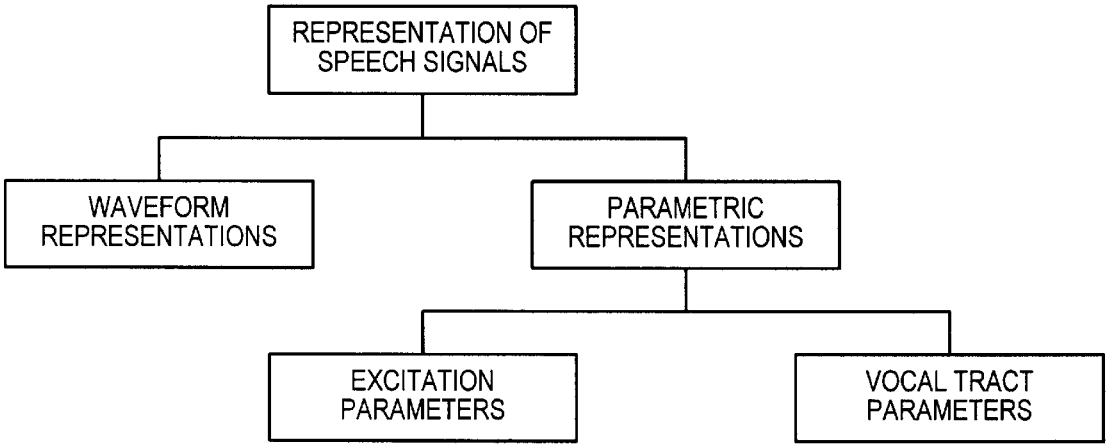
FIG. 1 (PRIOR ART)
FIG. 1 illustrates waveform representation and parametric representation methods used for representing speech signals.
Figure 2:
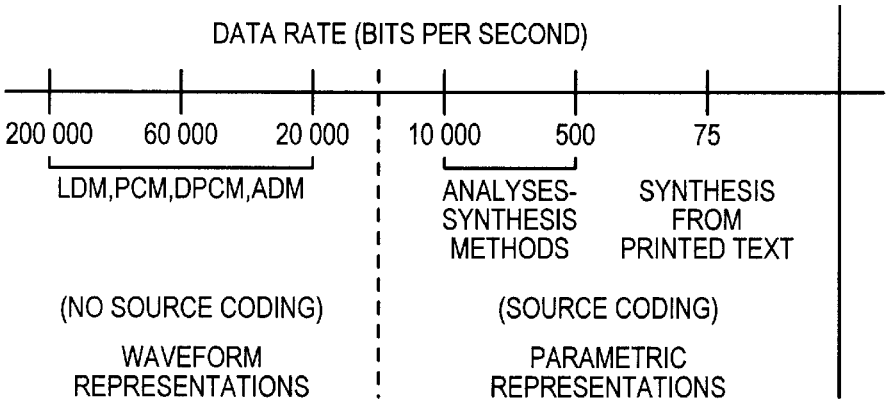
FIG. 2 (PRIOR ART)
FIG. 2 illustrates a range of bit rates for the speech representations illustrated in FIG. 1.
Figure 3:
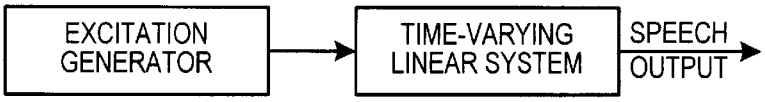
FIG. 3 (PRIOR ART)
FIG. 3 illustrates a basic model for speech production.
Figure 4:
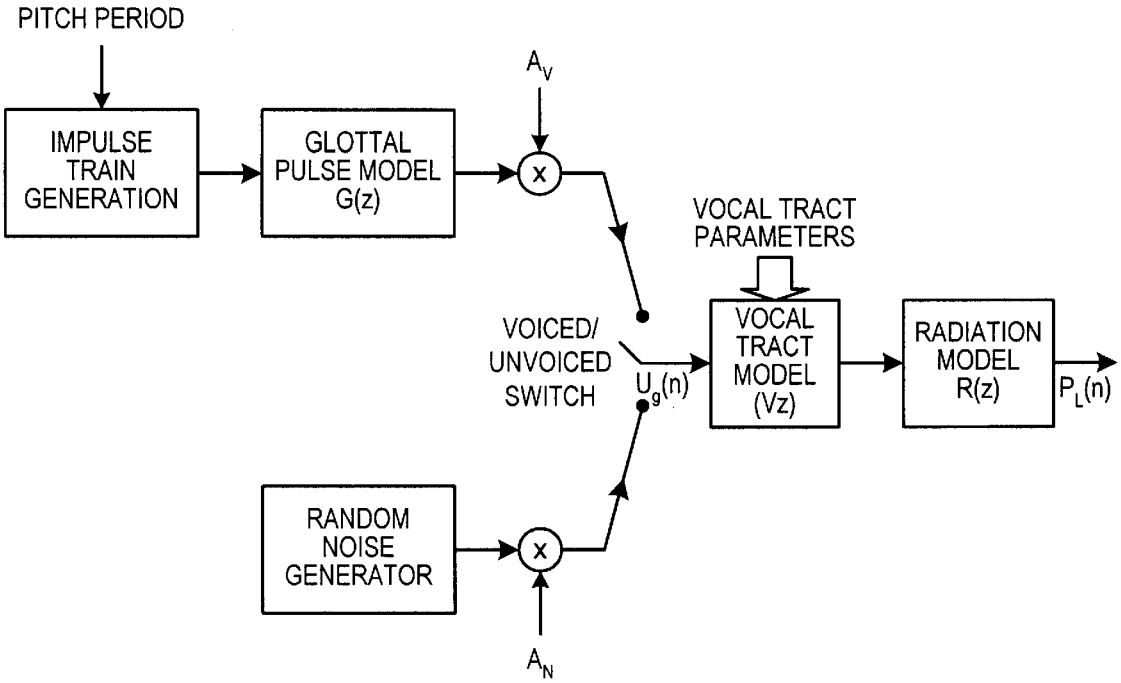
FIG. 4 (PRIOR ART)
FIG. 4 illustrates a generalized model for speech production.
Figure 5:
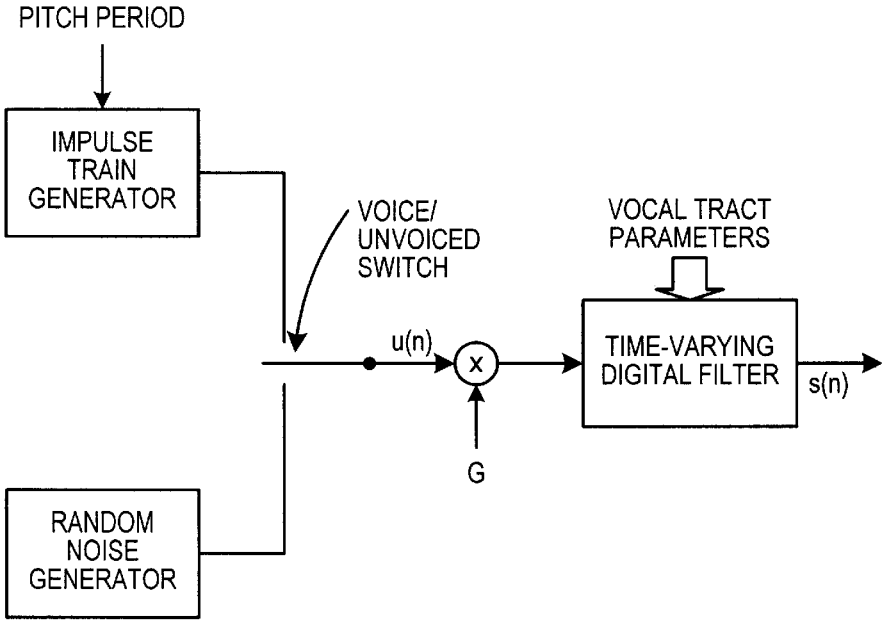
FIG. 5 (PRIOR ART)
FIG. 5 illustrates a model for speech production which includes a single time-varying digital filter.
Figure 6:
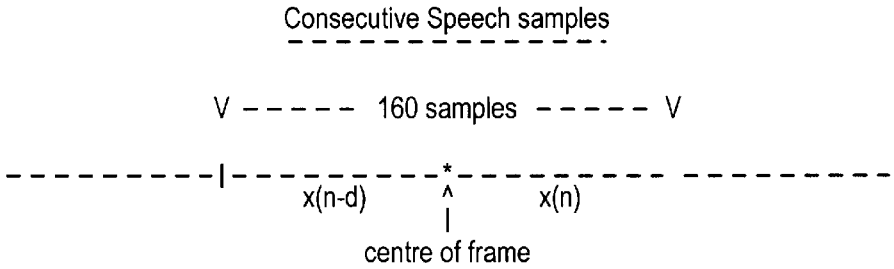
FIG. 6 (PRIOR ART)
FIG. 6 illustrates a time domain correlation method for measuring the similarity of two sequences of digital speech samples.
Figure 7:
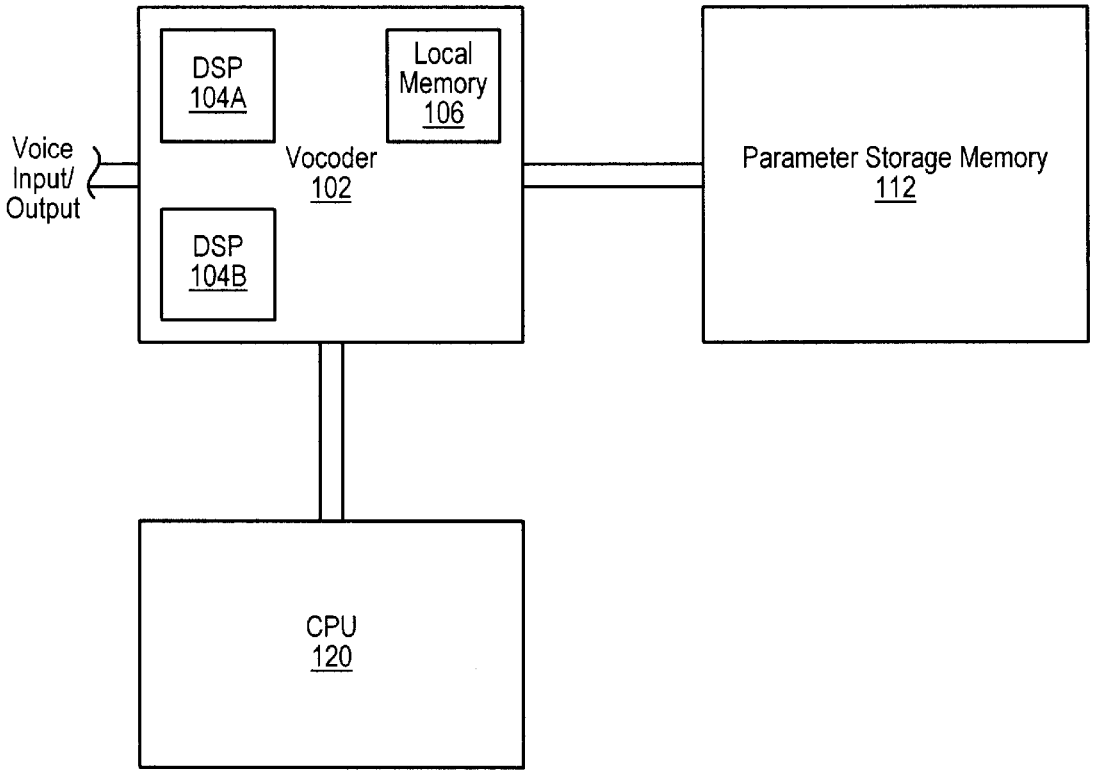
FIG. 7 is a block diagram of a speech storage system according to one embodiment of the present invention.

Referring now to FIG. 7, a block diagram illustrating a voice storage and retrieval system or vocoder according to one embodiment of the invention is shown. The voice storage and retrieval system shown in FIG. 7 can be used in various applications, including digital answering machines, digital voice mail systems, digital voice recorders, call servers, and other applications which require storage and retrieval of digital voice data. In the preferred embodiment, the voice storage and retrieval system is used in a digital answering machine.

As shown, the voice storage and retrieval system preferably includes a dedicated voice coder/decoder (vocoder or codec) 102. The voice coder/decoder 102 preferably includes two or more digital signal processors (DSPs) 104A and 104B, and local DSP memory 106. The local memory 106 serves as an analysis memory used by the DSPs 104A and 104B in performing voice coding and decoding functions, i.e., voice compression and decompression, as well as optional parameter data smoothing. The local memory 106 preferably operates at a speed equivalent to the DSPs 104A and 104B and thus has a relatively fast access time. In the preferred embodiment, the DSP 104A performs LPC calculations for a frame while the DSP 104B performs a pre-filtered pitch estimation on the frame substantially in parallel according to the present invention.

The voice coder/decoder 102 is coupled to a parameter storage memory 112. The storage memory 112 is used for storing coded voice parameters corresponding to the received voice input signal. In one embodiment, the storage memory 112 is preferably low cost (slow) dynamic random access memory (DRAM). However, it is noted that the storage memory 112 may comprise other storage media, such as a magnetic disk, flash memory, or other suitable storage media. A CPU 120 is preferably coupled to the voice coder/decoder 102 and controls operations of the voice coder/decoder 102, including operations of the DSPs 104A and 104B and the DSP local memory 106 within the voice coder/decoder 102. The CPU 120 also performs memory management functions for the voice coder/decoder 102 and the storage memory 112.

Alternate Embodiment

Figure 8:
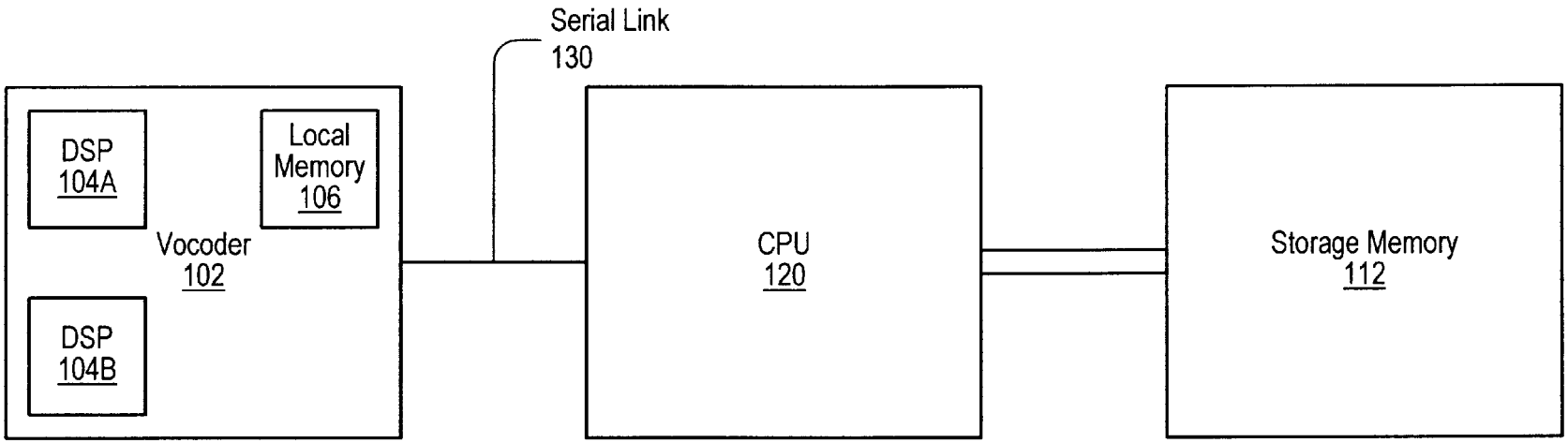
FIG. 8 is a block diagram of a speech storage system according to a second embodiment of the present invention.

Referring now to FIG. 8, an alternate embodiment of the voice storage and retrieval system is shown. Elements in FIG. 8 which correspond to elements in FIG. 7 have the same reference numerals for convenience. As shown, the voice coder/decoder 102 couples to the CPU 120 through a serial link 130. The CPU 120 in turn couples to the parameter storage memory 112 as shown. The serial link 130 may comprise a dumb serial bus which is only capable of providing data from the storage memory 112 in the order that the data is stored within the storage memory 112. Alternatively, the serial link 130 may be a demand serial link, where the DSPs 104A and 104B control the demand for parameters in the storage memory 112 and randomly accesses desired parameters in the storage memory 112 regardless of how the parameters are stored. The embodiment of FIG. 8 can also more closely resemble the embodiment of FIG. 7, whereby the voice coder/decoder 102 couples directly to the storage memory 112 via the serial link 130. In addition, a higher bandwidth bus, such as an 8-bit or 16-bit bus, may be coupled between the voice coder/decoder 102 and the CPU 120.

It is noted that the present invention may be incorporated into various types of voice processing systems having various types of configurations or architectures, and that the systems described above are representative only.

Low Bit Rate Vocoder

In the preferred embodiment, the vocoder is a low bit rate speech coder which analyzes several frames of speech data together and/or in parallel. The vocoder preferably performs a method whereby all of the frames being examined in parallel are block coded using Vector Quantisation techniques to reduce the bit rate for transmission. Such methods allow Look-ahead and Look-back techniques to be employed to correct for individual parameter estimation errors. In the preferred embodiment, the vocoder analyzes 3 speech frames together, where information from all 3 frames is used in the correction and estimation process.

Encoding Voice Data

Figure 9:
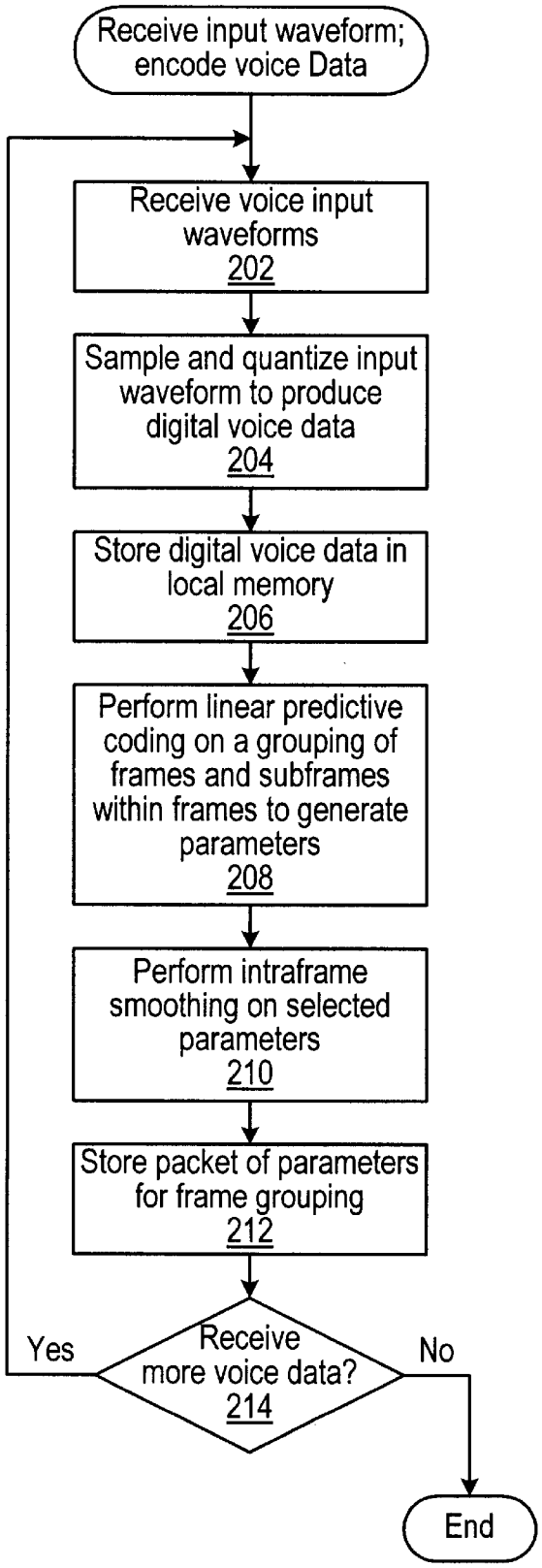
FIG. 9 is a flowchart diagram illustrating operation of speech signal encoding.

Referring now to FIG. 9, a flowchart diagram illustrating operation of the system of FIG. 7 encoding voice or speech signals into parametric data is shown. This figure illustrates one embodiment of how speech parameters are generated, and it is noted that various other methods may be used to generate the speech parameters using the present invention, as desired.

In step 202 the voice coder/decoder (vocoder) 102 receives voice input waveforms, which are analog waveforms corresponding to speech. In step 204 the vocoder 102 samples and quantizes the input waveforms to produce digital voice data. The vocoder 102 samples the input waveform according to a desired sampling rate. After sampling, the speech signal waveform is then quantized into digital values using a desired quantization method. In step 206 the vocoder 102 stores the digital voice data or digital waveform values in the local memory 106 for analysis by the vocoder 102.

While additional voice input data is being received, sampled, quantized, and stored in the local memory 106 in steps 202–206, the following steps are performed. In step 208 the vocoder 102 performs encoding on a grouping of frames of the digital voice data to derive a set of parameters which describe the voice content of the respective frames being examined. Various types of coding methods, including linear predictive coding, may be used. It is noted that any of various types of coding methods may be used, as desired. For more information on digital processing and coding of speech signals, please see Rabiner and Schafer, *Digital Processing of Speech Signals*, Prentice Hall, 1978, which is hereby incorporated by reference in its entirety. The present invention includes a novel system and method for pre-filtering first Formant energy from the speech data prior to the pitch estimation, wherein the pre-filtering requires reduced computational requirements and operates in conjunction with the LPC calculations.

In step 208 the vocoder 102 develops a set of parameters of different types for each frame of speech. The vocoder 102 generates one or more parameters for each frame which represent the characteristics of the speech signal, including a pitch parameter, a voice/unvoice parameter, a gain parameter, a magnitude parameter, and a multi-based excitation parameter, among others. The vocoder 102 may also generate other parameters for each frame or which span a grouping of multiple frames.

Once these parameters have been generated in step 208, in step 210 the vocoder 102 optionally performs intraframe smoothing on selected parameters. In an embodiment where intraframe smoothing is performed, a plurality of parameters of the same type are generated for each frame in step 208. Intraframe smoothing is applied in step 210 to reduce these plurality of parameters of the same type to a single parameter of that type. However, as noted above, the intraframe smoothing performed in step 210 is an optional step which may or may not be performed, as desired.

Once the coding has been performed on the respective grouping of frames to produce parameters in step 208, and any desired intraframe smoothing has been performed on selected parameters in step 210, the vocoder 102 stores this packet of parameters in the storage memory 112 in step 212. If more speech waveform data is being received by the voice coder/decoder 102 in step 214, then operation returns to step 202, and steps 202–214 are repeated.

Figure 10:
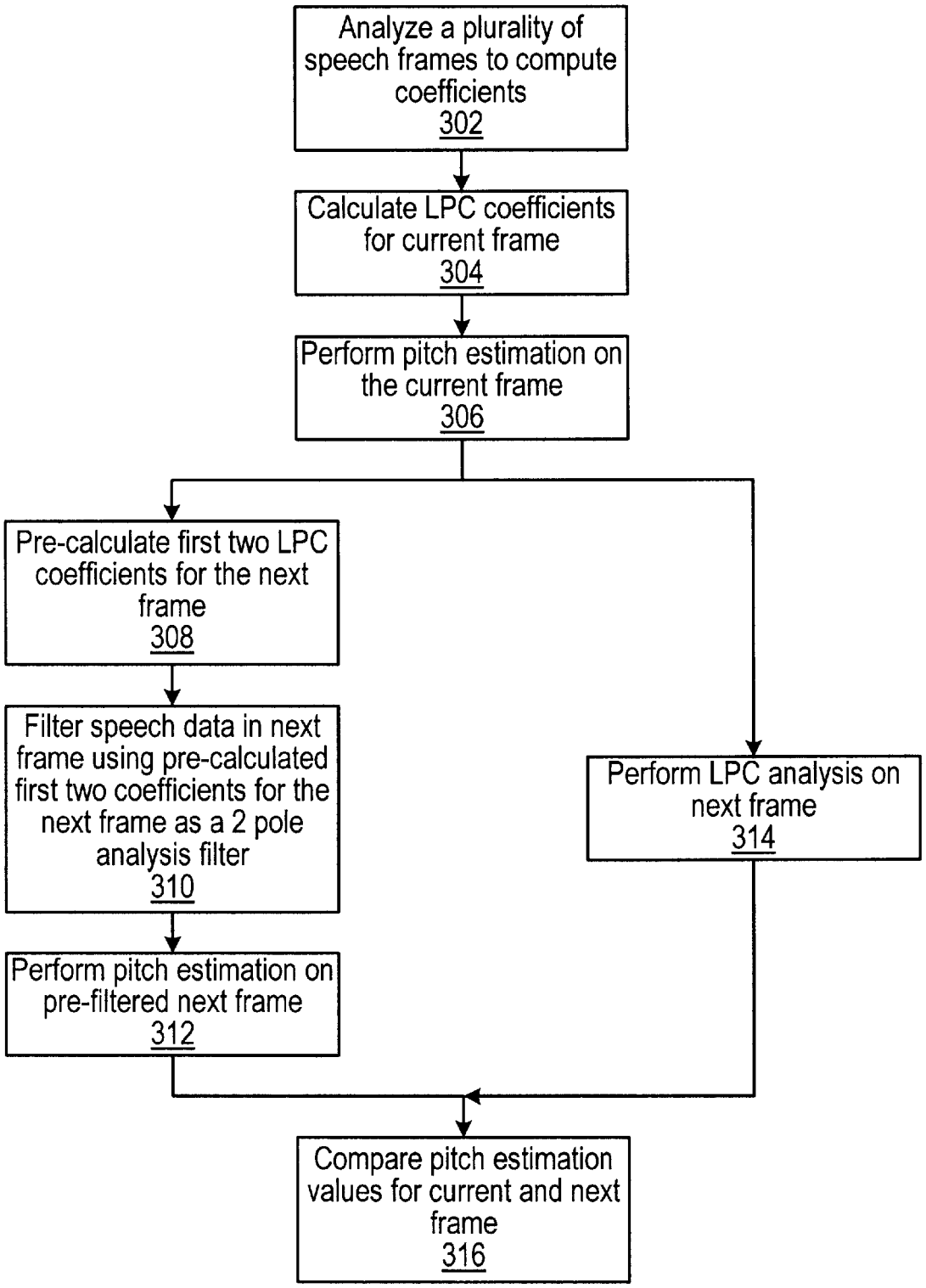
FIG. 10 is a flowchart diagram illustrating a first embodiment of the present invention.

FIG. 10—Pitch Estimation Method

Referring now to FIG. 10, a flowchart diagram is shown illustrating operation of a first embodiment of the present invention. This first embodiment pre-filters first Formant energy from speech data according to the present invention with reduced computational requirements. As shown, in step 302 the vocoder analyzes a plurality of speech frames to compute coefficients. Here it is assumed that the vocoder is a low bit rate vocoder which analyzes a plurality of speech data frames together and/or in parallel. In the preferred embodiment, all of the frames are block coded using vector quantization techniques to reduce the bit rate for transmission.

The vocoder 102 preferably analyzes two or more frames together in a group, including a first frame and a second frame. In the preferred embodiment, the vocoder 102 analyzes three speech frames together referred to as a previous, current and next frame of speech data. These three speech frames are analyzed in a manner which allows information from all three frames to be used in the estimation process.

In step 304 the vocoder 102 calculates the LPC coefficients for a first frame, such as the current frame. Here it may be presumed that the LPC coefficients for one or more prior frames, such as the previous frame, have already been calculated. In step 306 the vocoder 102 performs pitch estimation on the current frame, preferably using correlation techniques, to determine an estimated pitch value for the current frame. The calculated LPC coefficients may be used to pre-filter the data prior to the pitch estimation. It is noted that steps 304 and 306 may optionally be performed substantially in parallel by the DSPs 104A and 104B, respectively.

In step 314 the first DSP 104A performs LPC analysis on the next frame. Meanwhile, in steps 308–312 the second DSP 104B performs pre-filtering and pitch estimation on the next frame substantially in parallel with step 314 according to the present invention.

In step 308 the second DSP 104B pre-calculates a subset of the LPC coefficients for a second or subsequent frame, e.g., the next frame. In the preferred embodiment, in step 308 the second DSP 104B pre-calculates the first two LPC coefficients for the second or subsequent frame.

In step 310 the second DSP 104B filters speech data in the second frame or next frame using the pre-calculated subset of coefficients from the second frame calculated in step 308. This subset of pre-calculated coefficients is used as a multi-pole filter. In the preferred embodiment where the vocoder pre-calculates only the first two LPC coefficients for the second frame, the two pre-calculated LPC coefficients are used as a "crude" two pole analysis filter. This filter effectively filters the first formant energy from the speech data prior to pitch estimation.

After the pre-filtering in step 310, in step 312 the second DSP 104B performs pitch estimation on the second frame, preferably using correlation techniques. The pitch estimation in step 312 produces an estimated pitch value for the second or next frame.

Thus, the method of this embodiment pre-calculates a subset of LPC coefficients for a frame and uses this subset of LPC coefficients as a "crude" two pole analysis filter. Thus, the method of the present invention does not require that all of the LPC coefficients be computed prior to first Formant filtering, but rather only the first two LPC coefficients are computed. The first two LPC coefficients provide a sufficient number of coefficients for a "crude" multi pole analysis filter. This filter is effective in removing a substantial part of the first Formant energy from the speech data. This allows pre-filtered pitch estimation to be performed in parallel with the LPC computation. However, one drawback to this embodiment is that this method still requires some amount of processing to be performed prior to the pitch estimation.

In step 314 the vocoder 102 preferably compares pitch estimation value derived from the second frame of speech data to the pitch estimation value derived from the first frame of speech data to determine the accuracy of the pitch estimation value of the first frame of speech data.

Figure 11:
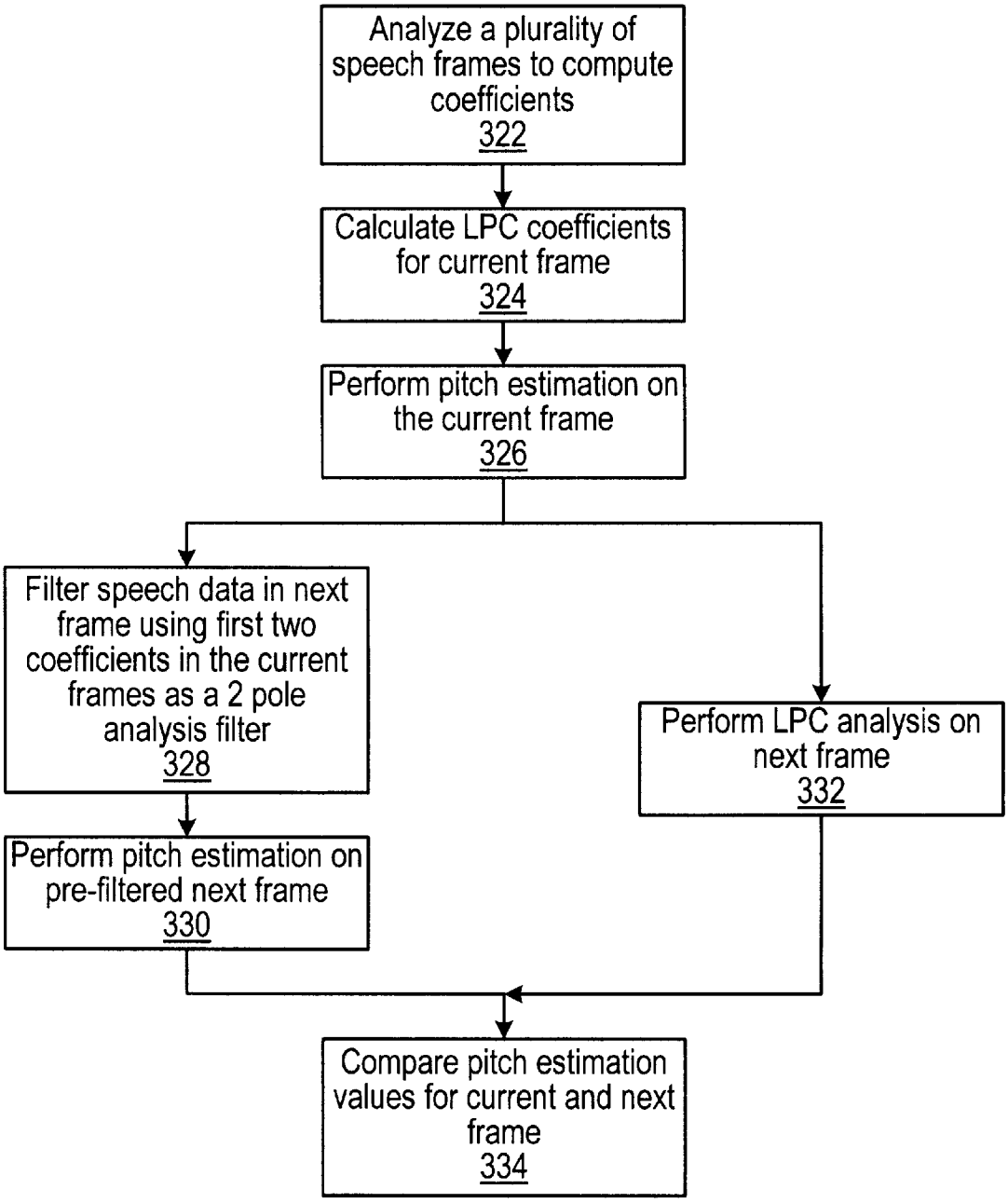
FIG. 11 is a flowchart diagram illustrating the preferred embodiment of the present invention.

FIG. 11—Pitch Estimation Method of the Preferred Embodiment

Referring now to FIG. 11, a flowchart diagram illustrating operation of the preferred embodiment of the present invention is shown. The preferred embodiment of FIG. 11 uses a plurality of coefficients for a first frame to pre-filter the data from a second or subsequent frame. Thus the method of FIG. 11 further minimizes the computational requirements while providing effective pre-filtering.

As shown, in step 322 the vocoder 102 analyzes a plurality of speech frames to compute coefficients. In step 324 the vocoder 102 calculates the LPC coefficients for a first frame, such as a current frame.

In step 326 the vocoder 102 performs pitch estimation on the current frame, preferably using correlation techniques, to determine an estimated pitch value for the current frame. The calculated LPC coefficients may be used to pre-filter the data prior to the pitch estimation. Alternatively, steps 324 and 326 may optionally be performed substantially in parallel by the DSPs 104A and 104B, respectively.

In step 332 the first DSP 104A performs LPC analysis on the next frame. Meanwhile, in steps 328–330 the second DSP 104B performs pre-filtering and pitch estimation on the next frame substantially in parallel with step 332 according to the present invention.

In step 328 the second DSP 104B filters speech data in a second or subsequent frame, i.e., the next frame, using at least a subset of the coefficients in the first or current frame calculated in step 324. The second DSP 104B preferably uses only a subset of the coefficients of the first frame for the pre-filter of the subsequent frame. This subset of coefficients from the first frame is used as a multi pole analysis filter for the second or next frame. In the preferred embodiment of the invention, in step 328 the second DSP 104B filters speech data in the next frame using the first two coefficients from the current frame calculated in step 324, wherein these first two coefficients are used as a two pole analysis filter.

After the pre-filtering in step 328, in step 330 the second DSP 104B performs pitch estimation on the second frame, preferably using correlation techniques. The pitch estimation in step 330 produces an estimated pitch value for the second or next frame.

Thus, the method of FIG. 11 employs the first two LPC coefficients of the current or first frame and uses these coefficients as a "crude" two pole analysis filter for pre-filtering the next frame data prior to pitch estimation. Thus, in the preferred embodiment, the second DSP 104B employs the first 2 LPC coefficients from the current frame and uses them as a crude 2 pole analysis filter for pre-filtering the next frame's data prior to pitch estimation. These coefficients are already available, having been calculated as part of the LPC analysis for the current frame. This allows pre-filtered pitch estimation to be performed in parallel with the LPC computation, whereby no additional computations are required for the pre-filtering. In other words, the pre-filtering step is not required to wait on any LPC computations before proceeding, but rather can immediately proceed in parallel with the LPC computations.

It is noted that the LPC coefficients representing the first Formant in voiced speech are, by nature, only a "short-term" estimate of the Formant, and do change from frame to frame. Thus, it is generally desired that coefficient generation or analysis be performed on a frame by frame basis for accurately calculating the best LPC Analysis Filter. However, this "crude" method of performing filtering on the next frame's data using a subset of the current frame's Filter coefficients removes a sufficient amount of the troublesome first Formant energy from the next frame signal to assist in the pitch estimation process.

In step 334 the vocoder 102, preferably the second DSP 104B, compares the pitch estimation value derived from the second frame of speech data to the pitch estimation value derived from the first frame of speech data to determine the accuracy of the pitch estimation value derived for the first frame of speech data. It is noted that the estimated pitch value for the second or next frame may be stored and/or used for other purposes, as desired.

Figure 12:
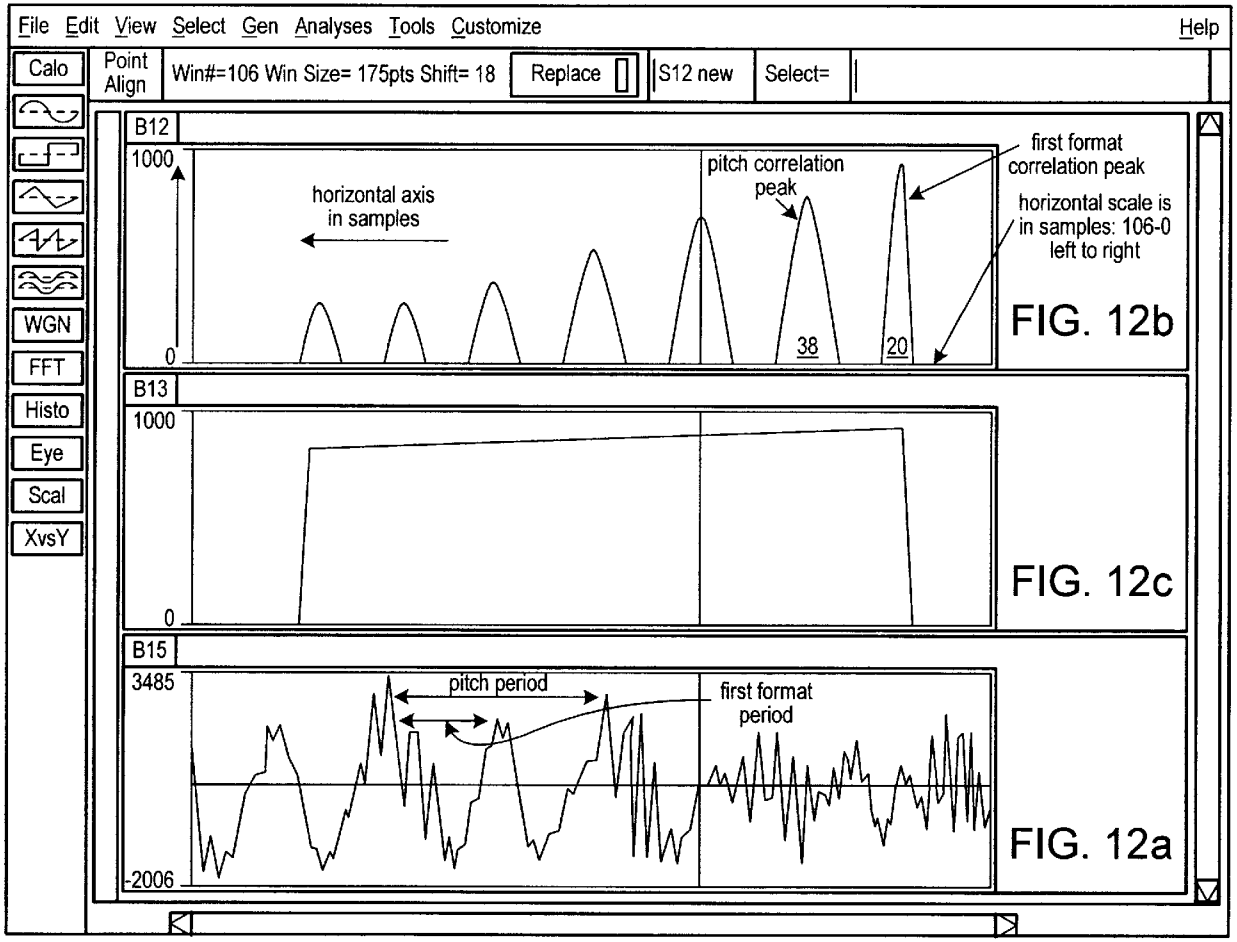
FIG. 12 (PRIOR ART)
FIG. 12 illustrates the correlation results of a prior art pitch estimation method, whereby

FIG. 12—Example Illustrating Pitch Estimation Using Prior Art Method

FIG. 12 illustrates operation of a correlation-based pitch estimation method according to prior art methods. FIG. 12*a* illustrates a speech waveform. FIG. 12*b* illustrates the correlation results using equations 1, 2 and 3 described above with a frame size of 160 samples. FIG. 12*c* shows the clipping threshold employed to reduce the number of peaks used in the estimation process. The horizontal axes of FIGS. 12*b* and 12*c*, although not marked, are measured in delay samples for each individual frame, and vary from 0 to 160, going from right to left.

Figure 14:
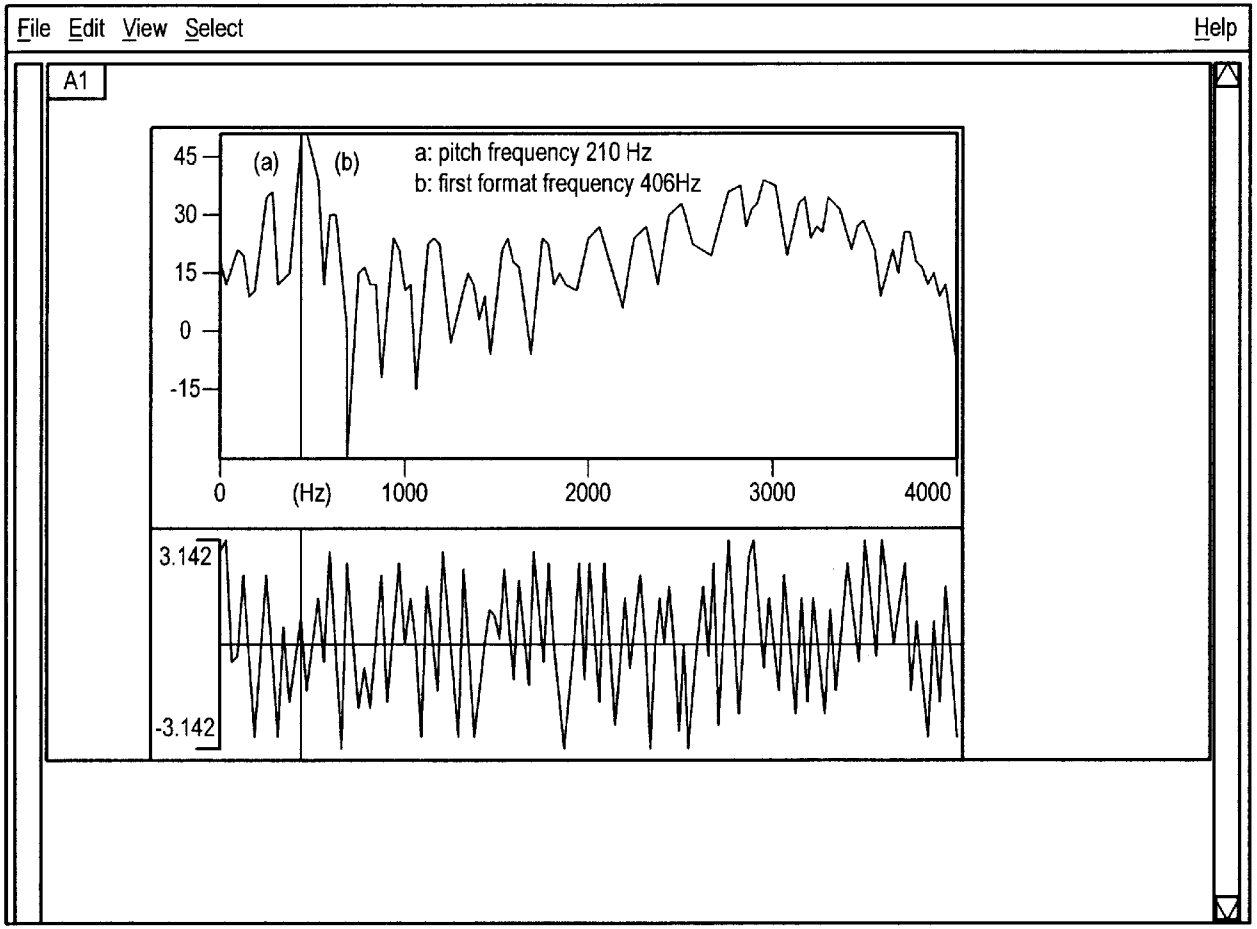
FIG. 14 illustrates a 256 sample FFT of the speech frame of FIG. 13*a*.

FIG. 12*a* illustrates a speech waveform which has a particularly difficult pitch estimation problem. Here the pitch period and the first Formant period are harmonically related in the ratio of approximately 2:1, where the period of the pitch is 38 samples at 8 KHz sampling rate or about 210 Hz and the First Formant has a period of about 19–20 samples at 8 KHz or about 406 Hz. FIG. 14 is an FFT of the next frame data on which the pitch estimation is to be performed.

FIG. 12*b*, at the rightmost portion of the graph, shows data from the pitch estimation on the next frame. Here it is noted that the particular pitch estimation technique used to generate this data in FIG. 12 employs time domain correlation of unfiltered speech data. In other words, this data is generated using prior art methods which does not pre-filter the "next frame" speech data prior to the pitch estimation. In FIG. 12*b*, a particularly strong correlation exists at the 20 sample point in the graph caused by the strong First Formant frequency. The next peak to the left of this first Formant peak at 38 samples is caused by the true pitch period. The remainder of the peaks in FIG. 12*b* are caused by first Formant and pitch multiples (harmonics) of the two fundamental peaks. As shown, these remaining peaks all fall below a decision threshold used to isolate only the strongest peaks for analysis. This decision threshold is illustrated in FIG. 12*c*. From analysis of the data in FIG. 12*b*, one would erroneously conclude that the pitch period is 20 samples with a strong second harmonic at ~38 samples.

Figure 13:
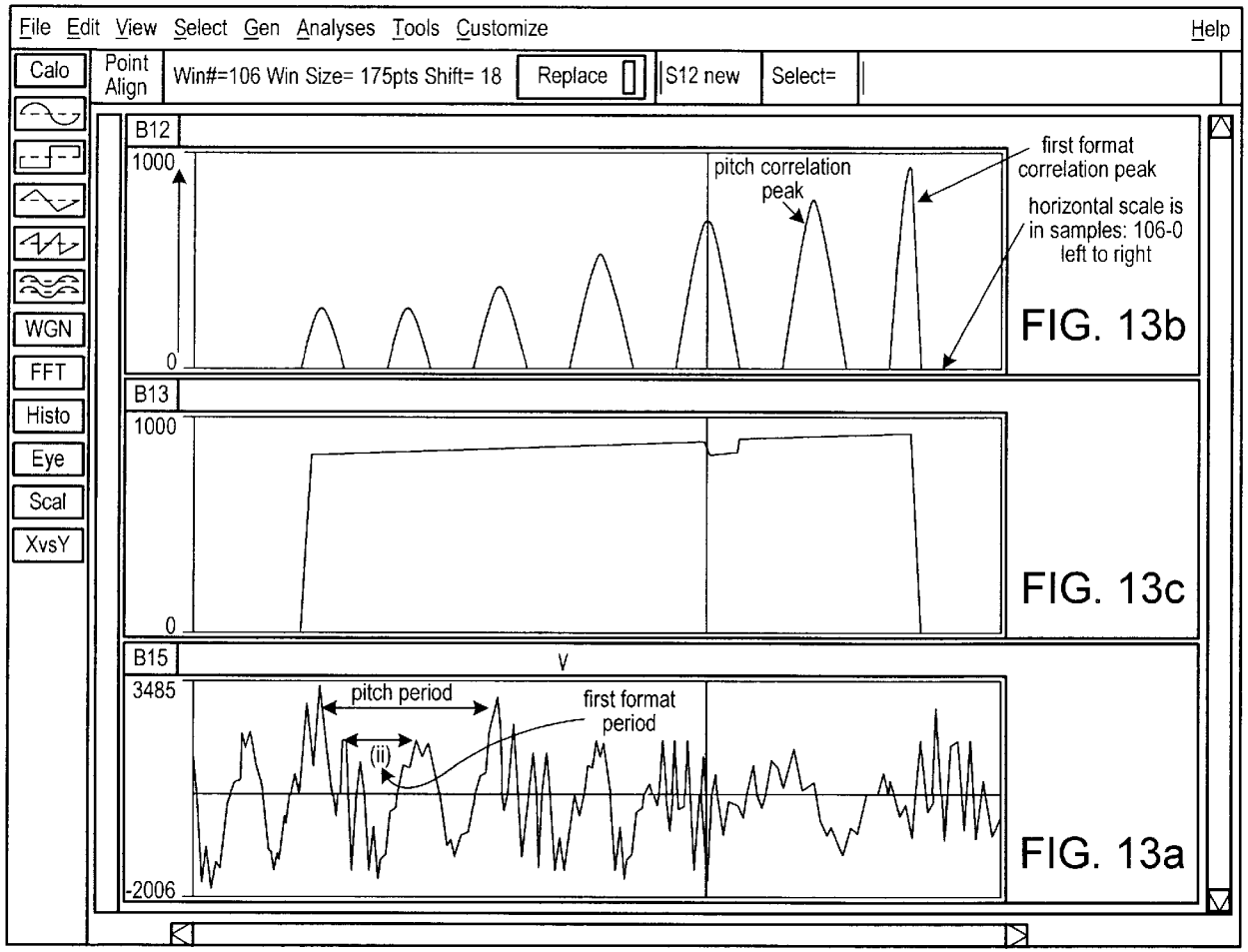
FIG. 13 illustrates the results of the pitch estimation method of the present invention, whereby
Figure 13A:
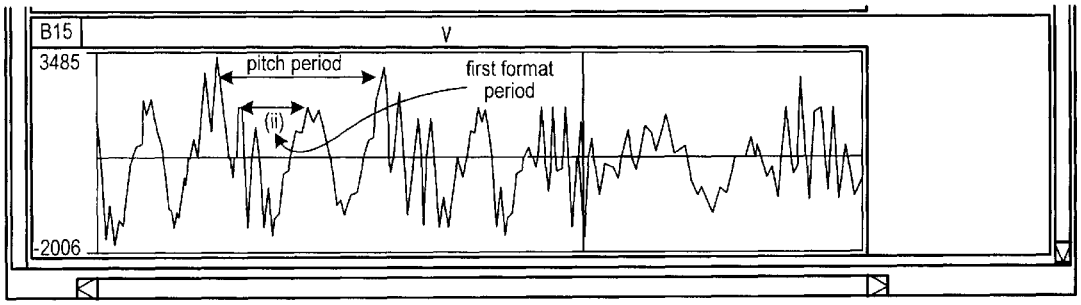
FIG. 13*a* illustrates a sample speech waveform.
Figure 13B:
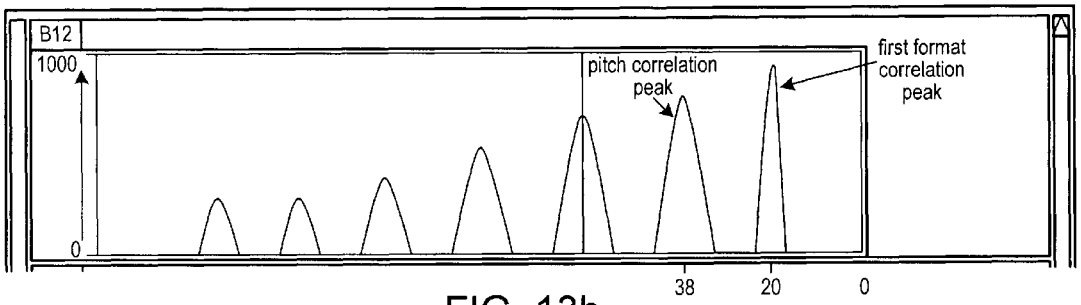
FIG. 13*b* illustrates a correlation output from the speech waveform of FIG. 13*a* using a frame size of 160 samples.
Figure 13C:
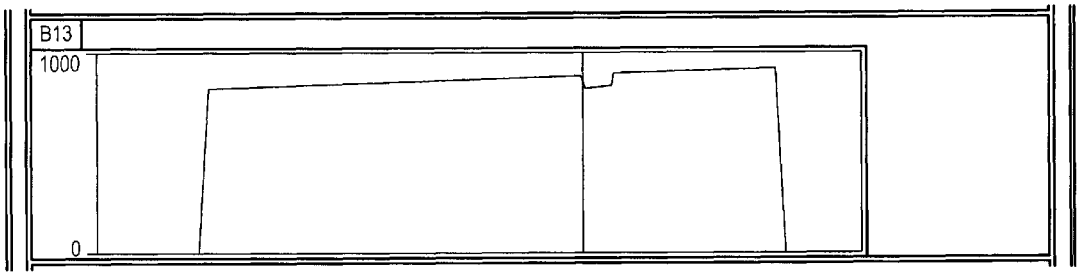
FIG. 13*c* illustrates the clipping threshold used to reduce the number of peaks in the estimation process.

FIG. 13—Example Illustrating Pitch Estimation According to the Present Invention FIG. 13 illustrates analysis of the same speech waveform of FIG. 12*a* according to the present invention. FIG. 13*a* illustrates the speech waveform shown in FIG. 12*a*. FIG. 13*b* illustrates the correlation results using equations 1, 2 and 3 described above with a frame size of 160 samples, wherein the correlation is performed after pre-filtering according to the preferred embodiment of the present invention. FIG. 13*c* shows the clipping threshold employed to reduce the number of peaks used in the estimation process. The horizontal axes of FIGS. 13*b* and 13*c*, although not marked, are measured in delay samples for each individual frame, and vary from 0 to 160, going from right to left.

As mentioned above with respect to FIG. 12*a*, FIG. 13*a* illustrates a speech waveform which has a particularly difficult pitch estimation problem. Here the pitch period and the first Formant period are harmonically related in the ratio of approximately 2:1, where the period of the pitch is 38 samples at 8 KHz sampling rate or about 210 Hz, and the First Formant has a period of about 19–20 samples at 8 KHz or about 406 Hz. FIG. 14 is an FFT of the next frame data on which the pitch estimation is to be performed.

FIG. 13 illustrates operation of the present invention where the next frame data has been pre-filtered according to the present invention. In FIG. 13, the next frame data has been pre-filtered using the first 2 LPC coefficients from the current LPC frame analysis. The first 2 LPC coefficients are used as an analysis filter prior to performing time domain correlation of the data. It is easily seen in this case that the level of the First Formant peak in FIG. 13*b* has been reduced to below the threshold level, thus excluding it from the pitch estimation process. This leaves only the peak at the 38 sample point as the data to be used in the estimation of the pitch for the next frame. The true pitch period is, therefore, accurately measured as 38 samples instead of 20 samples as in the method of FIG. 12.

It should be noted that, in the case where the pitch is 20 samples, the method of the present invention is still robust.

In this particular case, the crude LPC filter will again remove some of the First Formant energy, but since this peak is the pitch peak whose energy contribution is added to by the First Formant energy, it will show up as a stronger peak than that shown in FIG. 13*b*, and will therefore have a value above the threshold value. The peak at about the 40 sample position in FIG. 13*b* will also have a value above the threshold since it has energy contributions from harmonics of the pitch and the first Formant. Thus, enough information is available to the pitch estimation process to conclude that 20 samples is the period of the true pitch.

Conclusion

Therefore, the present invention comprises an improved vocoder system and method for more accurately and efficiently estimating the pitch parameter. The present invention comprises an improved system and method for pre-filtering first Formant data from a speech frame with improved efficiency and reduced computational requirements. The present invention performs pre-filtering and pitch estimation in parallel with LPC computations, thus improving performance.

Although the system and method of the present invention has been described in connection with the preferred embodiment, it is not intended to be limited to the specific form set forth herein, but on the contrary, it is intended to cover such alternatives, modifications, and equivalents, as can be reasonably included within the spirit and scope of the invention as defined by the appended claims.

We claim:

1. A method for performing pitch estimation which pre-filters speech data prior to pitch estimation with improved performance, comprising:

receiving a speech waveform comprising a plurality of frames;

analyzing a plurality of speech frames, wherein said plurality of speech frames include a first frame of speech data and a second frame of speech data;

calculating coefficients for said first frame of speech data;

filtering said second frame of speech data, wherein said filtering uses one or more coefficients from said first frame of speech data as a multi-pole analysis filter, wherein said filtering removes undesired signal information from said speech data in said second frame;

performing pitch estimation on said second frame of speech data after said filtering;

wherein said filtering removes first Formant energy from said second frame of speech data.

2. The method of claim 1, further comprising:

calculating coefficients for said second frame of speech data;

wherein said filtering said second frame of speech data occurs in parallel with said calculating coefficients for said second frame of speech data.

3. The method of claim 2, wherein said performing pitch estimation on said second frame of speech data occurs in parallel with said calculating coefficients for said second frame of speech data.

4. The method of claim 3, wherein said calculating coefficients for said first frame of speech data comprises calculating LPC coefficients for said first frame of speech data;

wherein said calculating coefficients for said second frame of speech data comprises calculating LPC coefficients for said second frame of speech data.

5. The method of claim 1, wherein said filtering uses two coefficients from said first frame of speech data as a two-pole analysis filter.

6. The method of claim 1, further comprising:

performing pitch estimation on said first frame of speech data using said calculated coefficients;

comparing said pitch estimation of said second frame of speech data to said pitch estimation of said first frame of speech data to determine accuracy of said pitch estimation of said first frame of speech data.

7. The method of claim 1, wherein said analyzing a plurality of speech frames comprises analyzing three frames, said three frames comprising a previous frame, a current frame and a next frame, wherein said current frame is said first frame and said next frame is said second frame.

8. A vocoder which pre-filters speech data prior to pitch estimation with improved performance, comprising:

means for receiving a plurality of digital samples of a speech waveform, wherein the speech waveform includes a plurality of frames each comprising a plurality of samples;

two or more processors for analyzing a plurality of speech frames, wherein said plurality of speech frames include a first frame of speech data and a second frame of speech data, wherein said two or more processors include:

a first processor which calculates coefficients for said first frame of speech data, wherein said first processor also calculates coefficients for said second frame of speech data; and a second processor which filters said second frame of speech data using one or more coefficients from said first frame of speech data as a multi-pole analysis filter, wherein said filtering removes undesired signal information from said speech data in said second frame; wherein said second processor also performs pitch estimation on said second frame of speech data after said filtering, wherein said second processor performs said filtering of said second frame of speech data in parallel with operation of said first processor calculating coefficients for said second frame of speech data;

wherein said second processor filters said second frame of speech data using said one or more coefficients from said first frame of speech data as a multi-pole analysis filter to remove first Formant energy from said second frame of speech data.

9. The vocoder of claim 8, wherein said second processor filters said second frame of speech data using two coefficients from said first frame of speech data as a two-pole analysis filter.

10. The vocoder of claim 8, wherein said first processor calculates LPC coefficients for said first frame of speech data;

wherein said first processor calculates LPC coefficients for said second frame of speech data.

11. The vocoder of claim 8, wherein said second processor performs pitch estimation on said first frame of speech data using said calculated coefficients from said first frame of speech data;

wherein said second processor compares said pitch estimation of said second frame of speech data to said pitch estimation of said first frame of speech data to determine accuracy of said pitch estimation of said first frame of speech data.

12. The vocoder of claim 8, wherein said first and second processors analyze three frames comprising a previous frame, a current frame and a next frame, wherein said current frame is said first frame and said next frame is said second frame.

13. A method for performing pitch estimation which pre-filters speech data prior to pitch estimation with improved performance, comprising:

receiving a speech waveform comprising a plurality of frames;

analyzing a plurality of speech frames, wherein said plurality of speech frames include a first frame of speech data and a second frame of speech data;

calculating coefficients for said first frame of speech data;

calculating a subset of coefficients for said second frame of speech data;

filtering said second frame of speech data, wherein said filtering uses said subset of coefficients from said second frame of speech data as a multi-pole analysis filter, wherein said filtering removes undesired signal information from said speech data in said second frame;

performing pitch estimation on said second frame of speech data after said filtering;

wherein said filtering removes first Formant energy from said second frame of speech data.

14. The method of claim 13, wherein said filtering said second frame of speech data occurs in parallel with said calculating a subset of coefficients for said second frame of speech data.

15. The method of claim 14, wherein said performing pitch estimation on said second frame of speech data occurs in parallel with said calculating a subset of coefficients for said second frame of speech data.

16. The method of claim 13, wherein said filtering uses two coefficients from said second frame of speech data as a two-pole analysis filter.

17. The method of claim 13, wherein said calculating coefficients for said first frame of speech data comprises calculating LPC coefficients for said first frame of speech data;

wherein said calculating said subset of coefficients for said second frame of speech data comprises calculating a subset of LPC coefficients for said second frame of speech data.

18. The method of claim 13, further comprising:

performing pitch estimation on said first frame of speech data using said calculated coefficients;

comparing said pitch estimation of said second frame of speech data to said pitch estimation of said first frame of speech data to determine accuracy of said pitch estimation of said first frame of speech data.

19. The method of claim 13, wherein said analyzing a plurality of speech frames comprises analyzing three frames, said three frames comprising a previous frame, a current frame and a next frame, wherein said current frame is said first frame and said next frame is said second frame.

20. A vocoder which pre-filters speech data prior to pitch estimation with improved performance, comprising:

means for receiving a plurality of digital samples of a speech waveform, wherein the speech waveform includes a plurality of frames each comprising a plurality of samples;

a processor for analyzing a plurality of speech frames, wherein said plurality of speech frames include a first frame of speech data and a second frame of speech data, wherein said processor calculates coefficients for said first frame of speech data, wherein said processor filters said second frame of speech data using one or more coefficients from said first frame of speech data as a multi-pole analysis filter, wherein said filtering removes undesired signal information from said speech data in said second frame;

wherein said processor performs pitch estimation on said second frame of speech data after said filtering;

wherein said processor filters said second frame of speech data using said one or more coefficients from said first frame of speech data as a multi-pole analysis filter to remove first Formant energy from said second frame of speech data.

* * * * *